US007744069B2

(12) United States Patent
Hoefken

(10) Patent No.: US 7,744,069 B2
(45) Date of Patent: Jun. 29, 2010

(54) DEVICE FOR GASSING LIQUIDS, IN PARTICULAR WASTE WATER

(75) Inventor: Marcus Hoefken, Erlangen (DE)

(73) Assignee: Invent Umwelt-Und Verfahrenstechnik AG, Erlangen (DE)

( * ) Notice: Subject to any disclaimer, the term of this patent is extended or adjusted under 35 U.S.C. 154(b) by 814 days.

(21) Appl. No.: 11/631,619

(22) PCT Filed: Jun. 15, 2005

(86) PCT No.: PCT/EP2005/006395

§ 371 (c)(1),
(2), (4) Date: Feb. 6, 2007

(87) PCT Pub. No.: WO2006/002759

PCT Pub. Date: Jan. 12, 2006

(65) Prior Publication Data

US 2008/0018002 A1 Jan. 24, 2008

(30) Foreign Application Priority Data

Jul. 5, 2004 (DE) ..... 10 2004 032 622
Jul. 28, 2004 (DE) ..... 10 2004 036 634

(51) Int. Cl.
*B01F 3/04* (2006.01)

(52) U.S. Cl. ..... 261/122.1; 261/124

(58) Field of Classification Search ..... 261/122.1, 261/122.2, 124, DIG. 70
See application file for complete search history.

(56) References Cited

U.S. PATENT DOCUMENTS

| | | | | |
|---|---|---|---|---|
| 2,101,311 | A | 12/1937 | Duncan | |
| 2,326,243 | A | 8/1943 | Meyer | |
| 2,963,783 | A | 12/1960 | Field | |
| 3,424,443 | A * | 1/1969 | Thayer | 261/123 |
| 4,279,842 | A * | 7/1981 | Belveal | 261/124 |
| 4,294,476 | A | 10/1981 | Nash | |
| 4,474,714 | A * | 10/1984 | Downs | 261/124 |
| 4,491,349 | A | 1/1985 | Rice et al. | |
| 4,818,446 | A * | 4/1989 | Schreiber et al. | 261/122.2 |
| 5,304,301 | A * | 4/1994 | Schmidt | 210/220 |
| 5,393,106 | A | 2/1995 | Schroeder | |
| 5,538,293 | A | 7/1996 | Kolt | |
| 5,676,890 | A * | 10/1997 | Ott | 261/122.2 |
| 5,788,847 | A | 8/1998 | Tharp | |
| 6,808,165 | B1 * | 10/2004 | Sperber et al. | 261/87 |
| 7,014,176 | B2 * | 3/2006 | Sebastiani et al. | 261/122.1 |
| 2002/0033544 | A1 * | 3/2002 | Jager | 261/122.1 |
| 2004/0094849 | A1 * | 5/2004 | Jager | 261/122.1 |

FOREIGN PATENT DOCUMENTS

| | | | |
|---|---|---|---|
| DE | 1 230 398 | | 12/1966 |
| DE | G92 01 820.3 | | 5/1992 |
| DE | 43 15 700 | A1 | 11/1994 |
| DE | 195 37 112 | A1 | 4/1996 |
| DE | 196 45 781 | C1 | 5/1998 |
| EP | 0 732 788 | A1 | 3/1996 |
| EP | 1 181 973 | A1 | 2/2002 |
| EP | 1 358 928 | A1 | 11/2003 |
| WO | WO 02/078825 | | 10/2002 |

* cited by examiner

*Primary Examiner*—Scott Bushey
(74) *Attorney, Agent, or Firm*—Manabu Kanesaka

(57) ABSTRACT

The invention relates to a device for gassing liquids, particularly waste water, including a gas supply line (1) and at least one gassing element (2), which has a longitudinal axis (L) and can be attached to the gas supply line in a positive manner. In order to simplify the mounting of the gassing element (2), the invention provides that the gassing element (2) has at least one fixing plate (8), which laterally projects relative to the longitudinal axis (L) and which serves to establish a non-positive connection with the gas supply line (1).

10 Claims, 5 Drawing Sheets

DEVICE FOR GASSING LIQUIDS, IN PARTICULAR WASTE WATER

Figure 1:
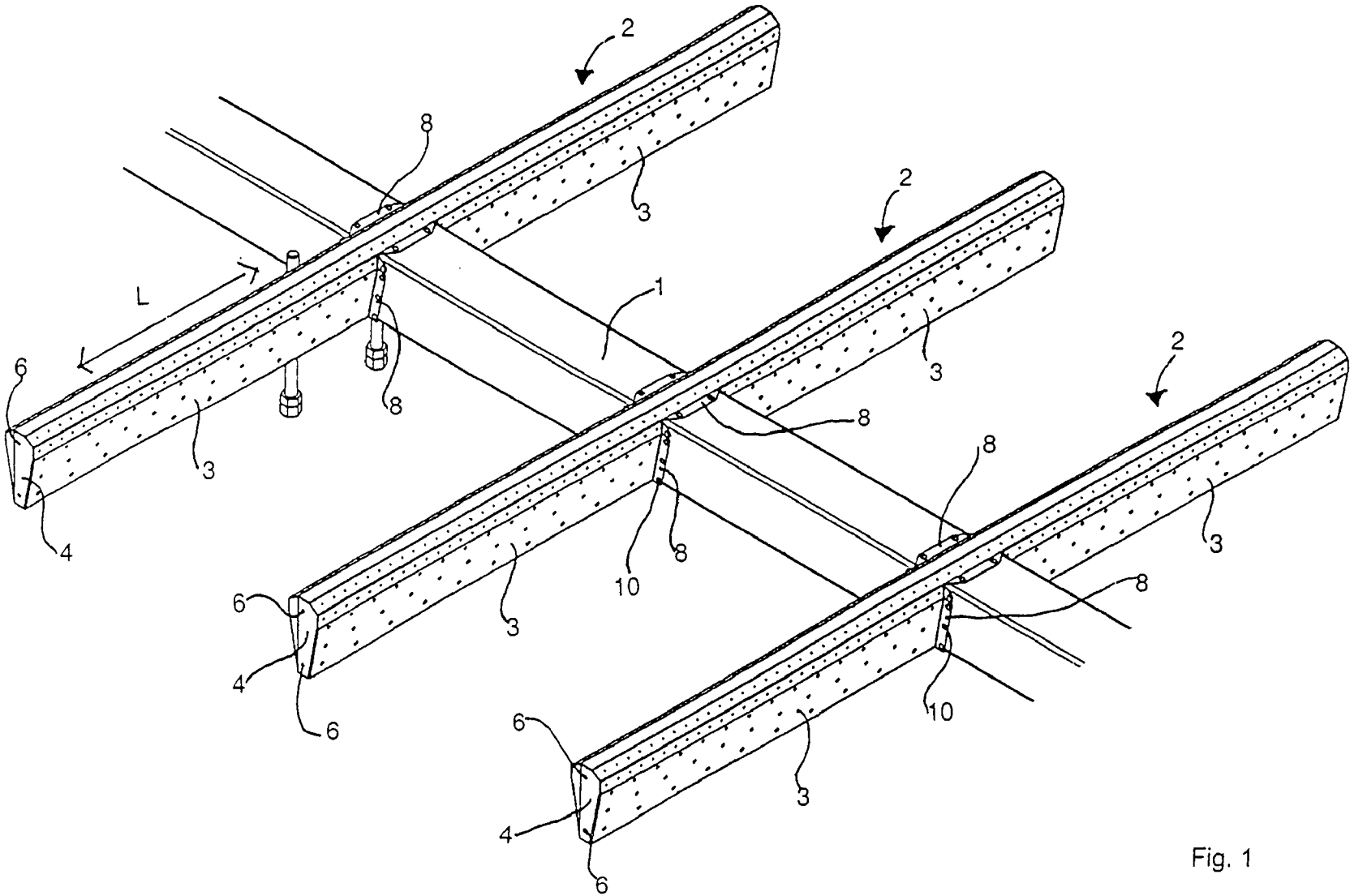

The invention relates to a device for gassing liquids, in particular waste water. Furthermore it relates to a method for making such a device.

From DE 196 45 781 C1 a device is known, in which a gas supply line is clamped in clips fixed to the bottom of a sewage tank. A gassing element mounted on the gas supply line is fixed with a bolt which, starting from the clip, passes through the gas supply line and the gassing element, and a nut screwed thereon. The fixation of the gassing element requires disadvantageously the provision of the previously stated clips. The clips must first be mounted in a specified arrangement on the bottom of a sewage tank which requires time and money.

From DE 195 37 112 C2 a further gassing device is known. With this the gassing element has a connecting piece with a connector. To mount the gassing element the connector is inserted into a corresponding breakthrough on the gas supply line. The gassing element is secured with a special nut on the gas supply line which has extensions which reach through the connector. Preparation for mounting first requires here, that the nut is interlocked with a screw which reaches through the gassing element. This can only be done manually and thus incurs costs. Additional costs are created by the provision of the specially designed nut.

In addition, according to prior art from the prospectus "The "Original" Stainless Steel Wide Band Non-Clog Diffuser" of the company Sanitaire Water Pollution Control Corp., US published in September 1983, an aerating element having a longitudinal axis is known, which is equipped with a conical thread nipple for connection to a gas supply line. The provision of such a thread nipple is expensive. The thread nipple must be made separately and must be connected to the gassing element by welding. Furthermore it is necessary to provide corresponding threads in the gas supply line for screwing in the thread nipple. Furthermore mounting requires the application of sealing means to the thread, so that a leak-proof connection between the gassing element and the gas supply tube is established in the correct mounting position.

Object of the invention is to eliminate the disadvantages of the prior art. In particular a device for the gassing of liquids is to be specified, which can be made and mounted in the simplest possible manner. According to a further objective of the invention a quick and simple method of mounting the device is to be specified.

According to the invention, it is provided on the device side that the gassing element has at least one fixing plate projecting laterally relative to the longitudinal axis to establish of a force-fit connection with the gas supply line. Such a fixing plate can be provided when the gassing element is made. A separate manufacturing process is not necessary. The fixing plate can be manufactured automatically. In this case, manual mounting work is not necessary.

The fixing plate provided by the invention permits a force-fit connection of the gassing element to the gas supply line in a simple manner using conventional mounting elements. Mounting of the device is simplified and accelerated. This can save costs for the provision of workers.

According to an advantageous embodiment the fixing plate abuts against the gas supply line in a form-fit manner in the mounting state. This prevents the uncontrolled escape of gas in the mounting area. Essentially all the gas supplied by the gas supply line is introduced into the gassing element attached to the supply line.

According to a particularly advantageous embodiment the gassing element is made in one piece from a sheet metal. The sheet metal can be a stainless steel plate. To make the gassing element, a suitable contour can first be cut out of the sheet metal and then bent to create the gassing element. Any overlapping walls formed by the bending can then be in a force-fit manner connected to each other by providing mounting elements such as rivets, for example. Such a gassing element can be made inexpensively.

It is useful when the fixing plate is a sheet metal portion made by bending. The sheet metal portion is bent opposite to the longitudinal axis of the gassing element usefully by an angle of 80 to 100°, advantageously by 90°. The making of such a fixing plate is particularly simple. In this case it is part of the one-piece gassing element made from a piece of sheet metal.

According to a further advantageous embodiment the gassing element is attached to the gas supply line with mounting elements reaching through the fixing plate. The mounting elements can be rivets, screw rivets, screws or the like. Such mounting elements, in particular rivets, can be quickly and easily attached to establish a force-fit connection.

First breakthroughs in the fixing plate can be provided for leading through the mounting elements. In the same manner second breakthroughs corresponding to the first breakthroughs can be provided in the gas supply line for leading through the mounting elements. The first and the second breakthroughs can be made by cutting the sheet metal with a laser. Mounting then no longer requires that holes are drilled for leading through the mounting elements. This reduces mounting work. It is advantageous that aerating breakthroughs provided in the gassing element are circular, oval, cornered or slit-shaped. When the aerating breakthroughs are cornered, they can be three-cornered, four-cornered, five-cornered, six-cornered and other types of multiple-cornered shapes. The opening surface of the aerating breakthroughs can decrease as the distance to the gas supply line increases. The opening surface is usefully selected so that an even gas inlet is provided in the liquid over the entire length of the aerating element.

According to a further embodiment it is provided that a cross sectional surface running vertical to the longitudinal axis of the gassing element decreases as the distance to the gas supply line increases. Also this measure serves to ensure a gas inlet that is as even as possible into the fluid over the entire length of the gassing element. For this purpose the opening surface of the aerating breakthroughs in the gassing element can increase in the direction from top to bottom. This means that an upper row of aerating breakthroughs has a smaller opening surface than a further row of aerating breakthroughs located there below.

In a further advantageous embodiment it is provided that the gassing element has two aerating arms. In this case the gassing element can be formed symmetrically. During mounting to the gas supply line the weight distribution is equalized. The suggested embodiment is particularly long-lived and durable.

At least one fixing plate can be provided on each of the aerating arms. However, it is advantageous when each of the aerating arms has several fixing plates, for example two vertical fixing plates and one horizontal fixing plate. This can be used to divert forces created by the weight of the aerating element, particularly over the vertically running fixing plates, to the gas supply line. It is useful that the gassing element in the design with two aerating arms is formed so that, it can be slipped onto the gas supply line together with the fixing plates in a form-fit manner. This simplifies mounting. A further simplification of mounting can be that grooves or ridges can be formed on the fixing plates which work together with corresponding ridges or grooves on the gas supply line so that the first breakthroughs provided in the fixing plates in the slipped-on state of the mounting element are directed towards the second breakthroughs provided in the gas supply line. This further simplifies mounting.

According to a further provision of the invention a method is provided for the mounting of the device of the invention with the following steps:

Placing the gassing element on the gas supply line so that the fixing plate is positioned next to the gas supply line and Mounting the gassing element on the gas supply line with the mounting elements reaching through the fixing plate.

The suggested method provides a quick and simple way to mount the gassing element on the gas supply line. The gassing element can for example be quickly and easily in a force-fit manner attached with rivets to the gassing line. Surprisingly it was found, that a device provided by the suggested mounting method has excellent mechanical stability and is particularly long-lived in practical application.

Figure 2:
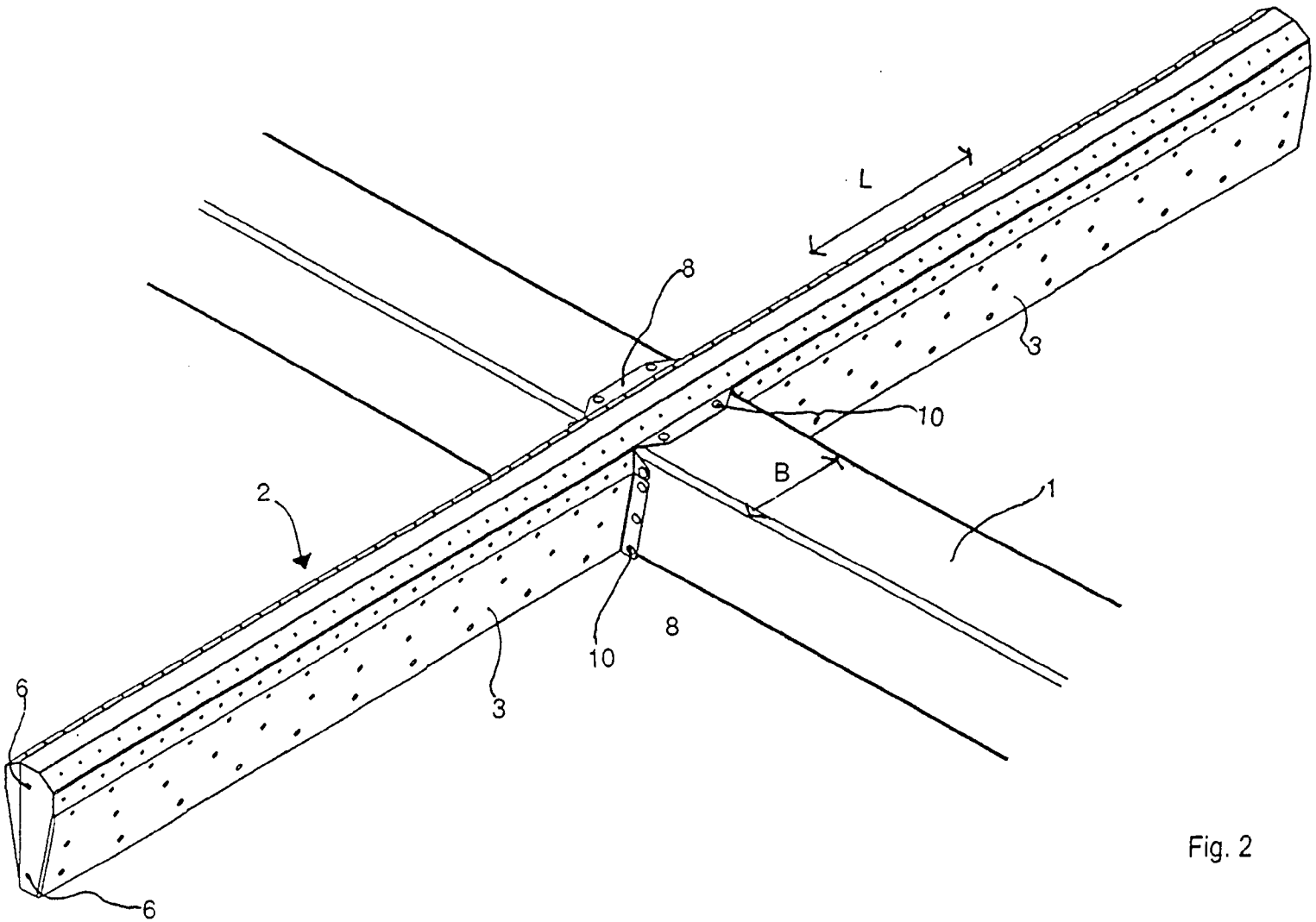
Figure 3:
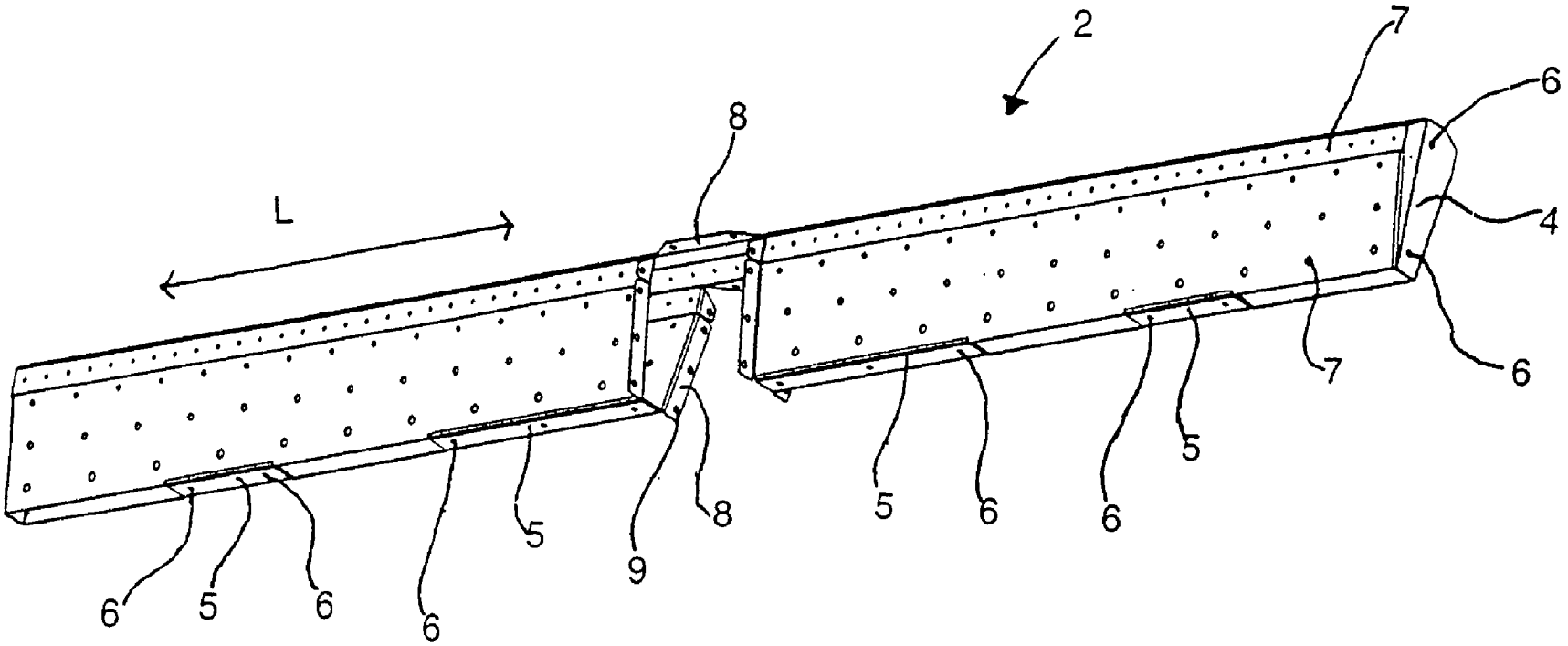
Figure 4:
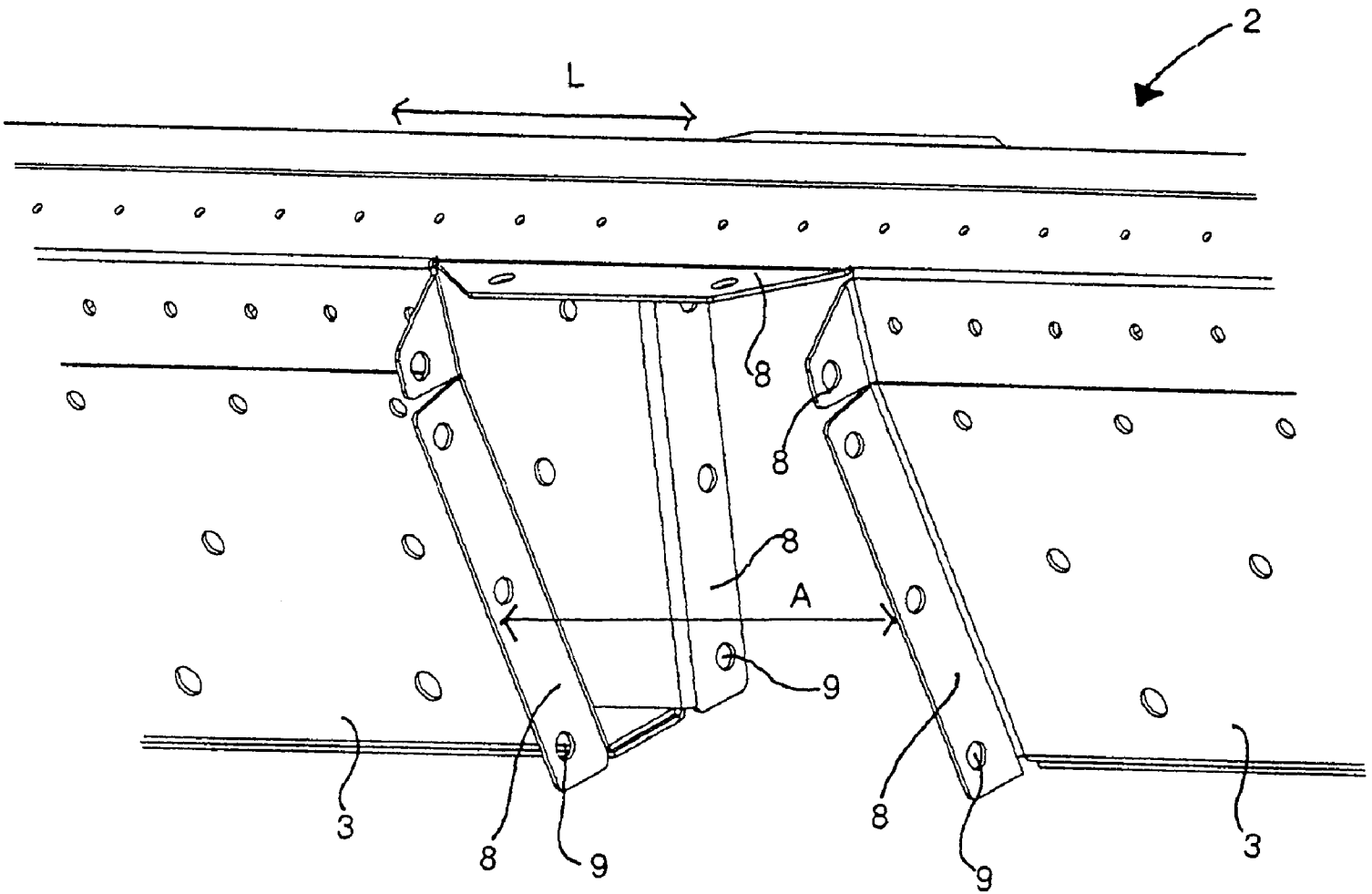
Figure 5:
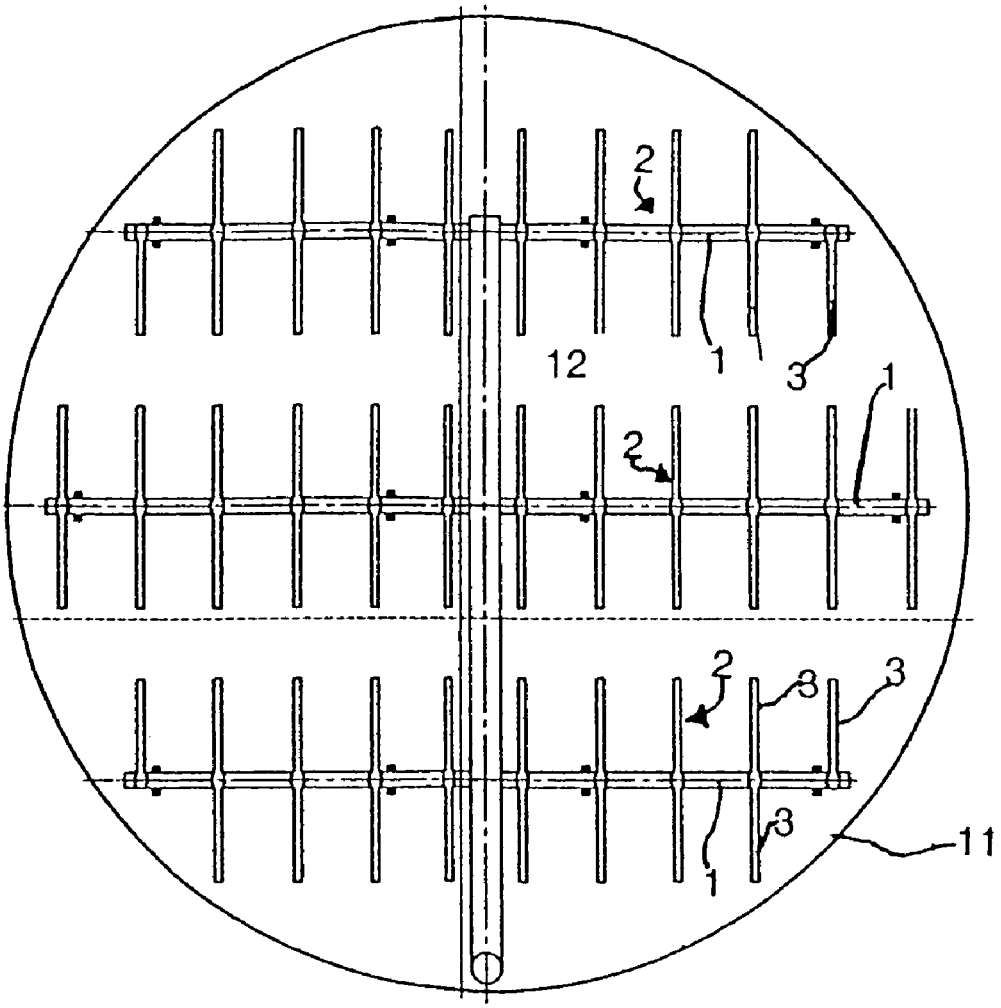
Figure 6:
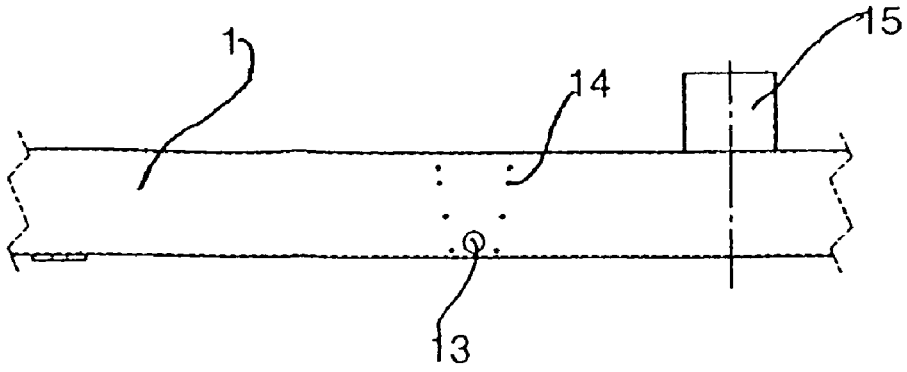

Hereinafter, an example of an embodiment of the invention will be explained with reference to the drawings. It shows:

FIG. 1 A perspective view of the device,

FIG. 2 an enlarged section of the device shown in FIG. 1,

FIG. 3 a perspective view of a gassing element,

FIG. 4 a perspective detailed view of the gassing element shown in FIG. 3, FIG. 5 a plan view to a device contained in a sewage tank and FIG. 6 a side view of a portion of the gas supply line.

With the device shown in FIGS. 1 and 2, several gassing elements 2 are connected to a gas supply line 1 essentially having a square cross section. The shown gassing elements 2 are symmetrically formed and have two aerating arms 3, respectively.

The gas supply line 1 has gassing breakthroughs (not shown here) opposite to each other in the respective connecting area of the gassing elements 2 through which the gas supplied by the gas supply line 1 enters the gassing elements 2.

As is particularly clear from FIG. 2 to 4, the gassing element 2 is made in one piece by bending a, preferably stainless, sheet metal. First sheet metal portions 4 overlapping on the front and second sheet metal portions 5 overlapping in the bottom area are connected in a force-fit manner with each other via first rivets 6. As is particularly clear from FIG. 3, the bottom of the aerating arms 3 must not be formed in a closed manner; it can have openings. In the area of the side walls as well as in the area of a ceiling, the aerating element has aerating breakthroughs 7. The aerating breakthroughs 7 can be formed circular, oval or also slit-shaped.

As is particularly clear from FIG. 4, in a connecting area the gassing element 2 has on each of the gassing arms 3 fixing plates 8 extending laterally from a longitudinal axis L of the gassing elements 2. The fixing plates 8 are provided with first breakthroughs 9. The fixing plates 8 are made in one piece with the gassing element 2 here by bending to the outside by approximately 90°. A distance A of two fixing plates 8 located opposite to each other is selected so that it essentially corresponds to a width B of the gas supply line 1. The fixing plates 8 are formed even, as well as the walls of the gas supply line 1. Due to this the mounting element 2 can be slipped onto the gas supply line 1 in a form-fit manner. In the slipped-on state, (not shown here) aerating breakthroughs of the aerating element 2 are completely covered.

As is particularly clear from FIGS. 1 and 2, the fixing plates 8 are connected in a force-fit manner with second rivets 10 to the gas supply line 1. For this purpose, second breakthroughs (not shown here) corresponding to the first breakthroughs 9 are provided in the gas supply line 1.

FIG. 5 shows a top view of a sewage tank 11. The sewage tank has several gas supply lines 1 which are connected with each other with a gas provision line 12. Several gassing elements 2 are connected to each of the gas supply lines 1. Gassing elements 2 which only have one aerating arm 3 are provided in the edges. Also, these gassing elements 2 are formed according to the invention, this means that they have fixing plates 8 which are attached to the gas supply line 1 with second rivets 10.

FIG. 6 shows a side view of the gas supply line 1. One gassing breakthrough 13 as well as the second breakthroughs 14 are provided in the connecting area for a gassing element 2.

In addition, the gas supply line 1 has a connector 15 for the connection to the gas provision line 12.

To mount the device, the gas supply line 1 must first be laid on a bottom, of the sewage tank 11 for example. Then in the area of the connection points provided thereon the gassing elements 2 are slipped on so that the first breakthroughs 9 are aligned with the second breakthroughs 14 provided in the gas supply line 1. Guide elements (not shown here) can be provided on the fixing plates 8 as well as on the opposite side wall of the gas supply line 1. This can be grooves running in the mating direction and ridges or the like corresponding thereto. Then second rivets, for example, are inserted and fixed by the first 9 and second breakthroughs 14 located in alignment. The non-positive connection created by this is durable. It can be established quickly and easily.

The gassing element 2 can be formed simply and inexpensively as a bent sheet metal piece. Its manufacturing requires no addition whatsoever of parts which must be welded. Furthermore, mounting of the suggested gassing element 2 does not require the provision of specially formed mounting materials. Conventional mounting elements can be used. The gas supply line 1 can also be formed as a bent sheet metal piece. In all, a device for the gassing of liquids, in particular of waste water, is provided which is simple and inexpensive to make and mount.

The invention claimed is:

1. Liquid gassing device, particularly waste water gassing device, with a gas supply line (1) and at least one gassing element (2), which has a longitudinal axis (L) and can be attached thereto in a form-fit manner, wherein the gassing element (2) has at least one fixing plate (8) projecting laterally relative to the longitudinal axis (L) to establish a force-fit connection with the gas supply line (1), and wherein the gassing element (2) is mounted on the gas supply line (1) with the mounting elements (10) reaching through the fixing plate (8), characterized in that the gassing element (2) made in one piece from a piece of sheet metal has two aerating arms (3), wherein each of the aerating arms (3) is provided with at least one fixing plate (8), wherein the gassing element (2) is formed so that, together with the fixing plates (8), it can be slipped onto the gas supply line (1) in a form-fit manner.

2. Liquid gassing device according to claim 1, wherein the fixing plate (8) is made by bending over a sheet metal portion.

3. Liquid gassing device according to claim 1, wherein the fixing elements (10) are rivets, screw rivets or screws.

4. Liquid gassing device according to claim 1, wherein first breakthroughs (9) are provided in the fixing plate (8) for leading through the fixing elements (10).

5. Liquid gassing device according to claim 4, wherein second breakthroughs (14) are provided in the gas supply line (1) corresponding to the first breakthroughs (9) for leading through the rivets (10) or screw rivets.

6. Liquid gassing device according to claim 1, wherein aerating breakthroughs (7) provided in the gassing element (2) are circular, oval, cornered or slit-shaped.

7. Liquid gassing device according to claim 1, wherein a cross sectional surface running vertical to the longitudinal axis (L) of the gassing element (2) decreases as the distance to the gas supply line (1) increases.

8. Liquid gassing device according to claim 6, wherein an opening surface of the aerating breakthroughs (7) provided in the gassing element (2) increases from top to bottom.

9. Method of mounting the liquid gassing device according to claim 1 consisting of the following steps:

slipping the gassing element (2) onto the gas supply line (1), so that the fixing plates (8) are positioned next to the gas supply line (1) in a form-fit manner, and mounting the gassing element (2) on the gas supply line (1) with the mounting elements (10) reaching through the mounting plates (8).

10. Method according to claim 9, wherein rivets, screw rivets or screws are used as mounting elements (10).

* * * * *